United States Patent [19]

Jacobson

[11] Patent Number: 4,844,286

[45] Date of Patent: Jul. 4, 1989

[54] PORTABLE SECONDARY CONTAINMENT APPARATUS FOR CHEMICALS

[76] Inventor: Clifford L. Jacobson, 705 Keenan Ct., Durham, Calif. 95938

[21] Appl. No.: 241,069

[22] Filed: Sep. 6, 1988

[51] Int. Cl.[4] ..... B65D 25/14

[52] U.S. Cl. ..... 220/401; 220/5 R; 220/404; 220/403; 383/121.2

[58] Field of Search ..... 220/401, 403, 404, 408, 220/470, 5 R; 383/121.1

[56] References Cited

U.S. PATENT DOCUMENTS

| | | | |
|---|---|---|---|
| 1,460,461 | 7/1923 | West . | |
| 2,426,475 | 8/1947 | van Frank . | |
| 2,464,069 | 3/1949 | Benson . | |
| 2,522,381 | 9/1950 | Kramer . | |
| 2,610,757 | 9/1952 | Irvine | 220/403 |
| 3,058,507 | 9/1960 | Patterson | 383/121.1 |
| 3,915,329 | 10/1975 | Zaks | 220/404 |

*Primary Examiner*—Stephen Marcus
*Assistant Examiner*—Gilbert W. Reece

[57] ABSTRACT

An apparatus comprising a large heavy gauge, chemically resistant plastic covering formed into a sac, having a closed bottom end and an opened top end, with the bottom end secured between two separate sections of a two-piece base platform provides secondary containment for leakage of toxic chemicals from heavy drums encased in the covering. The two-piece base platform includes a flat top downwardly convexed upper section positioned inside the covering at the closed bottom end which holds the covering securely by closely fitting a concaved center in a rounded bottom section of the base platform. The upper section of the base has a cover protecting rolled edge. Should a drum encased in the covering develop a leak, the spill is confined inside the covering protecting the surrounding area from contamination.

6 Claims, 2 Drawing Sheets

PORTABLE SECONDARY CONTAINMENT APPARATUS FOR CHEMICALS

BACKGROUND OF THE INVENTION

1. Field of the Invention

This invention relates to protective liquid containment systems in general, and more specifically to a secondary or back up containment apparatus for hazardous liquid chemicals.

2. Description of the Prior Art

Various methods are in use today to protect against inadvertent leakage of hazardous chemicals from their respective containers. Most of the protective packaging is focused on small breakable bottles wherein the main objective is prevention of damage to the container. Many of the hazardous chemicals used today in various industries are transported and stored in conventional fifty-five gallon drums, and leakage of the contents with subsequent contamination of the surrounding area has become a serious problem. A patent search was therefore conducted to uncover past art devices designed to prevent the distribution of hazardous chemicals originating from ruptures in large or heavy containers. The search was conducted in the following classes and subclasses:

150/52R, and 52F.

Patents considered pertinent to my invention include the following:

U.S. Pat. No. 1,460,461, issued to West on July 3, 1923, discloses a sanitary and temperature insulating jacket for milk cans.

Frank was granted U.S. Pat. No. 2,426,475, on Aug. 26, 1947, for a cooling jacket for milk cans.

On Mar. 8, 1949, Benson was issued U.S. Pat. No. 2,464,069, for a shock absorbent bottle carrier designed primarily to protect the glass bottle from breakage.

U.S. Pat. No. 2,522,381, was granted to Kramer on Sept. 12, 1950, for a temperature retaining cover for bottles.

The West and Frank devices are designed to provide cooling measures for milk cans and are not specifically concerned with preventing leakage. These two devices also show outer jackets having opened bottom surfaces which are connected to the containers by girding bands or sealing rings. Girding bands have not proven to be an effective sealing means when the exterior wall of the container contains dents or seams. Any irregularities in the smooth cylindrical exterior wall of the container against which the girding band is attached would allow seepage of spilled contents. The Frank device contains a supportive base affixed with an outer annular groove into which the bottom edge of the jacket is inserted and secured with a sealing ring. This sealing system is also adversely affected by dents in the wall of the annular groove as well as sand or other debris contained within the bottom of the groove. Both interfere with a sealing system which depends on a flush and even seal against the exterior wall of the container. The outward extending projection of the annular groove leaves it prone to damage caused by blows or impacts against other objects which could cause the afore mentioned dents and irregularities in the wall of the annular groove. The widespread practice of rolling large fifty-five gallon drums on the bottom edge to move them short distances would eliminate the use on the Frank patent due to the susceptibility of the annular groove to damage.

The Karmer patent shows an insulated cover designed to retain the heat of the contents of the container. This device would be unsuitable utilized as a protective liner to cover large and heavy drums in that the narrow bottom rim of the drum would be resting on the cover. The drum rim could cut into the cover as the drum is rolled on the bottom edge making perforations in the cover. This would allow leakage of the drum contents should a rupture occur.

Although the Benson patent appears to be most relevant to my invention, the design of the device is limited to small glass bottles. An effect similar to that occurring with the afore mentioned Kramer device would result if the Benson carrier were adapted to large or heavy drums. The result would be the same damage to the carrier previously mentioned from the bottom rim of the drum when it is rolled on edge.

Although not found in the patent search, large drums of chemicals are sometimes stored in open topped liquid tight containers. These secondary or back up drum containers have rigid side walls which require the chemical containing drum to be lifted above the open top of the back up container and be lowered inside. Since drums full of chemicals are very heavy, mechanical hoists are needed for the lifting process.

To my knowledge, the foregoing patents represent devices most pertinent to my invention. I did not consider any of the examined patented devices suitable for use with heavy or large drums and similar containers.

SUMMARY OF THE INVENTION

In practicing my invention, I have developed a secondary containment apparatus for protection against leakage of liquid and powdered chemicals stored in large or heavy drums and similar receptacles. My invention consists of a large heavy gauge, chemically resistant pliable covering, preferably plastic, formed into a sack having a closed bottom end and an opened top end. The closed bottom end is secured between two separate sections of a two-piece base platform. The two-piece platform consists of a first piece positioned upwardly and formed as a rounded flat top downwardly convexed section. The first piece or upwardly positioned section of the base platform is arranged to be inside the pliable covering at the bottom closed end when the pliable covering is rolled up. A second piece of the two-piece base platform is a rounded disc-like base with an upwardly concaved center. The second piece of the base is the downwardly positioned section and sits outside the pliable covering underneath at the closed bottom end. The bottom closed end of the pliable covering is in between the two base sections and the downwardly convexed upper section fits the upwardly concaved center of the downwardly section with the pliable covering held securely between the two sections. The upper section of the base has a cover protecting rolled edge to keep the lower side wall of the pliable covering out away from the edge of an encased drum. The pliable covering is arranged to be rolled upwards from the base to cover a drum or similar container and to be rolled down with the rolled material around the rounded disc-like lower section of the two-piece base platform. The weight of a drum and any contents in the drum sitting inside the covering on the upper base section holds the two base sections tightly together effectively securing the closed bottom of the covering between them.

Should a drum or other container filled with contaminating materials encased by the device of the present invention develop a leak, the covering would retain the leaked material and the surrounding area would be protected. In one embodiment of my invention, the liner has an opened top edge seamed with a slidable draw string. The top edge of the covering can be pulled over the top edge of the drum and tied in a position just leaving the drum spigot cap and the air vent fitting clear. A second embodiment of the invention is a complete covering of the drum with the top of the liner being gathered and affixed shut with a permanent tie. For insertion of a pump, a cut opening can be made just over the spigot cap. In a permanent storage situation, the gathered and tied top embodiment is best employed.

Therefore, it is a primary object of my invention to provide a secondary containment apparatus in the form of a covering and a two-piece base for chemicals stored in fifty-five gallon drums and other heavy containers, which does not require the use of hoisting equipment to utilize.

A further object of my invention is to provide a hazardous containment apparatus for heavy drums and similar containers in the form of a covering and a doubled base with the base structured to protect the bottom surface of the covering from damage by an edge of the drum rolling on the liner.

An even further object of my invention is to provide a hazardous containment covering for heavy drums and similar containers which allows the container to be filled or emptied without the removal of the protective covering.

A still further object of my invention is to provide a hazardous containment cover and double base for heavy drums and similar containers which is removable, reuseable, and collapsible for easy and compact storage.

Other objects and advantages of my invention will become apparent with a reading of the following specification and subsequent comparison of numbered parts described with similar numbered parts illustrated in the accompanying drawings.

DESCRIPTION OF THE PREFERRED EMBODIMENTS

Figure 1:
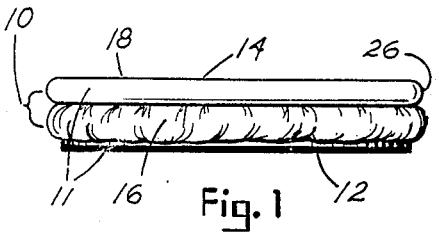
FIG. 1 shows the invention in collapsed attitude with the convexed upper base section positioned atop and fitting into the concaved lower round base section. The chemically resistant pliable covering is between the two base sections with the cover material rolled down around the lower base section. The cover protecting rolled edge of the upper base section is illustrated.
Figure 2:
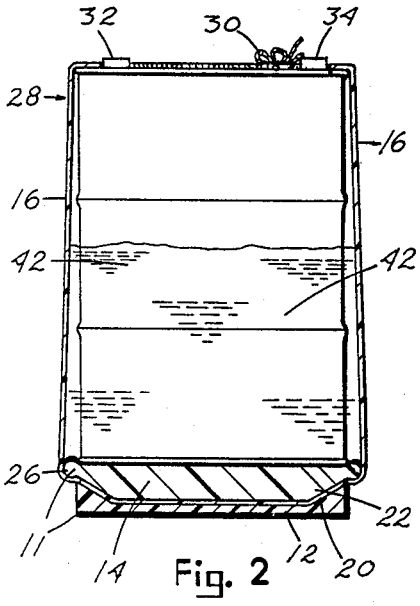
FIG. 2 is an opened structural view of the containment apparatus showing the chemically resistant pliable covering pulled up, tied by draw string at the top, and encasing a fifty-five gallon drum. The two interfitting base sections are illustrated in structural section. The spigot cap and the air vent fitting are clear of the covering.
Figure 3:
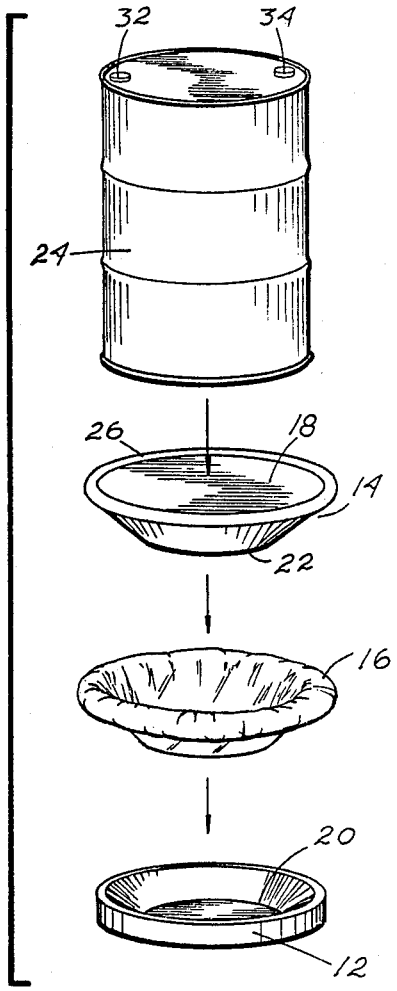
FIG. 3 is an exploded view showing a drum upwardly positioned for placement on the flat top of the downwardly convexed upper section of the two-piece base which sets inside of rolled down chemically resistant pliable covering which in turn rests in round concaved lower base section.
Figure 4:
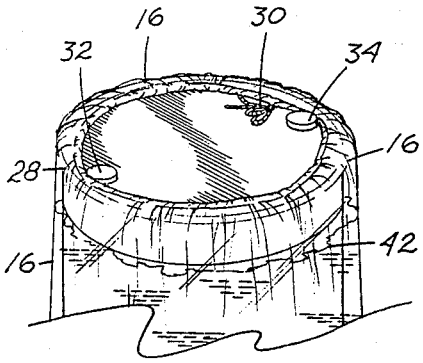
FIG. 4 is a partial perspective view of the opened top embodiment of the invention showing the chemically resistant pliable covering over the upper half of a drum with the draw string pulling the cover top over the upper edge of the drum leaving the spigot cap and the air vent fitting exposed.

Referring now to the drawings and to FIGS. 1, 2, and 4 which illustrate a first embodiment of the invention, opened top embodiment 28. The present invention is a secondary containment apparatus 10 useful for protection against leakage of toxic chemicals 42 stored in large or heavy receptacles such as drum 24. A large heavy gauge, chemically resistant pliable covering 16, preferably plastic, formed into a sack is closed at the bottom end and opened at the top end. The bottom end of chemically resistant pliable covering 16 is secured between two separate pieces of a two-piece base platform 11. The two pieces of two-piece base platform 11 include a first piece being upper base section 14 having a flat top 18 and a convexed bottom 22, and a second piece being rounded disc-like bottom base section 12 having a concaved upper center 20. Two-piece base platform 11 can be seen in FIG. 1 in part with the assemblage of secondary containment apparatus 10 but is best illustrated in FIG. 2. Upper base section 14 is arranged to be inside chemically resistant pliable covering 16 at the closed bottom end with flat top 18 positioned upwardly and convexed bottom center 22 downwardly. Rounded disc-like bottom base section 12 is positioned under the closed bottom end of pliable covering 16 with concaved upper center 20 upwardly. The upper base section 14 has a cover protecting rolled edge 26 arranged to prevent drum 24 from damaging chemically resistant pliable covering 16 by keeping the bottom edge out away from the bottom edge of drum 24. Convexed bottom center 22 of upper base section 14 fits inside concaved upper center 20 in rounded bottom base section 12 with the closed bottom end of pliable covering 16 between the two sections. Pliable covering 16 is arranged to be rolled upwardly from two-piece base 11 for covering drum 24, and to be rolled downwardly for storage or loading with the rolled material wrapped around rounded bottom base section 12. When chemically resistant pliable covering 16 is rolled up, upper base section 14 is inside at the bottom and chemically resistant pliable covering 16 is securely retained by the weight of drum 24 in the convexed bottom center 22 of upper base section 14 fitted in concaved upper center 20 of rounded bottom base section 12.

In use, chemically resistant pliable covering 16 is pulled up over the top edge of drum 24 in opened top embodiment 28. Draw string 30 is tightened leaving drum spigot cap 32 and air vent fitting 34 clear. Should drum 24 develop a leak, the surrounding area is protected from contamination by the contents of drum 24 being contained as illustrated in FIGS. 2 and 4. Leaked toxic chemicals 42 remain inside chemically resistant pliable covering 16.

Figure 7:
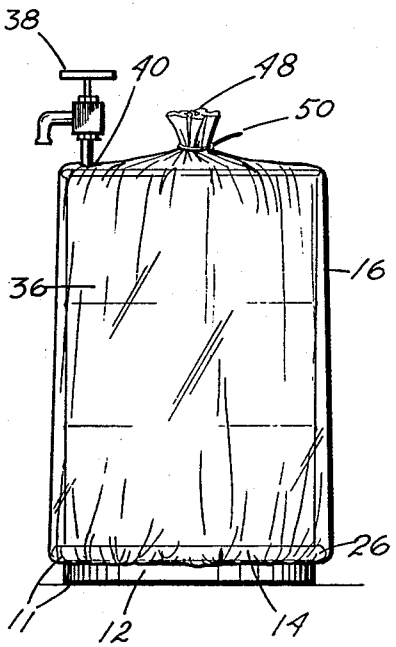
FIG. 7 shows the contaminate containing drum completely covered by the gathered and tied top embodiment of the present invention. The encased drum and the bottom of the covering are shown resting in the concaved top of the bottom section of the base held positioned by the upper convexed section of the base inside the covering. The pump is illustrated with the pump shaft passed through a cut in the cover top into the spigot receptacle.

In a second embodiment of the invention, gathered top embodiment 36, pliable covering 16 completely covers drum 24 as illustrated in FIG. 7. In this embodiment, the top of chemically resistant pliable covering 16 is closed into gathered top 48 and fixed shut with a permanent tie, gathered top tie lock 50. For insertion of pump 38, an opening is cut, spigot cap cut opening 40, just over drum spigot cap 32. Gathered top embodiment 36 is most useful for long time storage.

Figure 6:
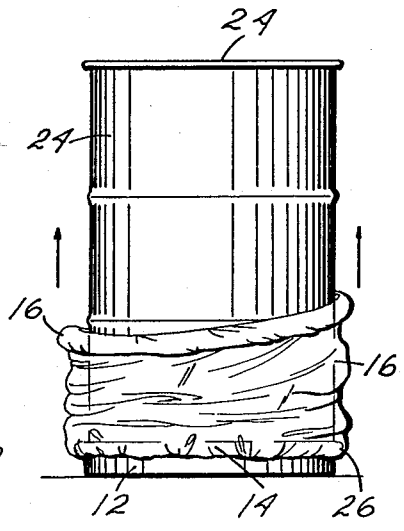
FIG. 6 shows the contaminant containing drum in position on the flat top upper base section with the cover protecting rolled edge of the upper base section holding the lower part of the chemically resistant pliable covering away from the drum base with the covering illustrated in the process of being rolled up along the sides of the drum.
Figure 5:
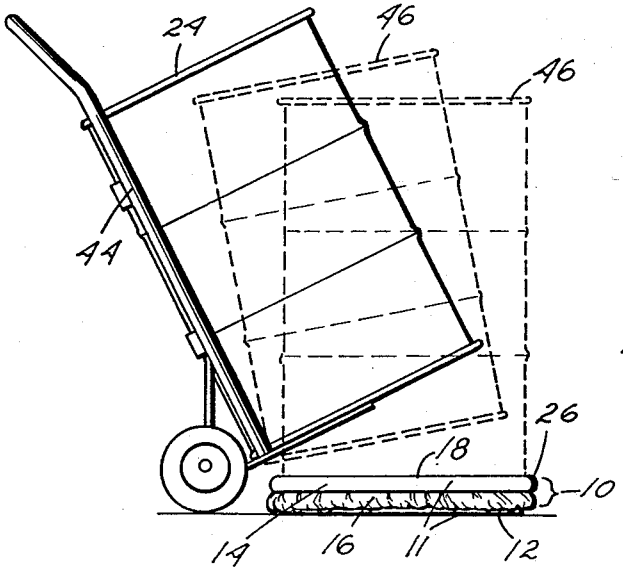
FIG. 5 illustrates a hand truck loading a contaminate containing fifty-five gallon drum onto the base platform of the invention. The chemically resistant pliable covering is shown between the two base sections and is rolled down around the lower round base section. The cover protecting rolled edge of the upper base section is shown adjacently above the rolled down covering.

FIG. 5 illustrates loading drum 24 onto the collapsed secondary containment apparatus 10 of either embodiment. As can be seen in FIG. 5, when rounded bottom base section 12 and upper base section 14 are assembled with chemically resistant pliable covering 16 between them and rolled down, secondary containment apparatus 10 presents a very low profile. Drum 24 is easily loaded from hand truck 44 onto the flat top 18 of upper base section 14 as drum loading positions 46 indicate. Cover protecting rolled ridge 26 prevents damage to chemically resistant pliable covering 16 from either the bottom edge of drum 24 or the load platform of hand truck 44. Cover protecting rolled ridge 26 also holds the lower edge of chemically resistant pliable covering 16 out away from the bottom rim of drum 24 further protecting the materials. FIG. 6 illustrates how chemically resistant pliable covering 16 is rolled up over drum 24 and FIG. 7 shows drum 24 completely covered and chemically resistant pliable covering 16 closed at the top by gathered top 48 and permanently fastened by gathered top tie lock 50.

Returning now to FIG. 2 and FIG. 4 where the main purpose and use of both embodiments of secondary containment apparatus 10 is illustrated. As shown, if drum 24 is filled with a contaminative fluid and a leak occurs, secondary containment apparatus 10, FIG. 2, would maintain the leaked toxic chemicals 42 inside chemically resistant pliable covering 16 and protect the surrounding area from contamination by the spilling liquid. In FIG. 4, opened top embodiment 28 is illustrated with contained leaked toxic chemicals 42 inside chemically resistant pliable covering 16 which illustrates the principal purpose and use of the present invention.

Although I have described preferred embodiments of my invention with considerable detail in the specification, it is to be understood that the invention is not limited to these precise forms of apparatus and that changes may be made therein without departing from the scope of the invention as defined in the appended claims.

The embodiments of the invention in which an exclusive property or privilege is claimed are defined as follows:

1. A secondary containment apparatus provided with chemically resistant reservoir structure sized to confine drums and similar receptacles and retain leakage of chemicals;

said secondary containment apparatus comprising, in a first embodiment, a chemically resistant pliable covering formed into a sack, having a closed bottom end and an opened top end, there being a draw string slidably seamed along the edge of said opened top end and said bottom end being secured between upper and lower sections of a two-piece rounded base platform, said pliable covering arranged to roll up from said base platform and to roll down around said base platform with the rolled material of said covering fitted downwardly around said lower section of said two-piece base platform;

said two-piece base platform comprising a first piece and a second piece;

said first piece being a rounded flat top downwardly convexed upper section arranged to position inside said covering at said closed bottom end when said pliable covering is rolled upwardly with said upper section holding said covering securely by closely fitting a concaved center in said second piece being a rounded bottom section of said two-piece base platform formed upwardly with said concaved center;

said upper section of said two-piece base platform having a cover protecting ring-like rolled edge there around;

means for applying weight to said flat top of said upper section of said two-piece platform providing pressurized retention of said closed bottom end of said covering secured between said two pieces of said two-piece base platform.

2. The device of claim 1 wherein said chemically resistant pliable covering is fabricated in a variety of suitable materials with a heavy gauge pliable plastic being the material of choice.

3. The device of claim 1 wherein said means for applying weight to said flat top of said upper section of said two-piece platform is a drum in the range of fifty-five gallon capacity or a similar container and any contents therein.

4. A secondary containment apparatus provided with chemically resistant reservoir structure sized to confine drums and similar receptacles and retain leakage of chemicals;

said secondary containment apparatus comprising, in a second embodiment, a chemically resistant pliable covering formed into a sack, having a closed bottom end and an opened top end, the edge of said opened top end arranged to be gathered and encompass said configured drums and similar receptacles, there being means for affixing a permanent tie lock to said gathered top end, said bottom end being secured between upper and lower sections of a two-piece rounded base platform, said pliable covering arranged to roll up from said base platform and to roll down around said base platform with the rolled material of said covering fitted downwardly around said lower section of said two-piece base platform;

said two-piece base platform comprising a first piece and a second piece;

said first piece being a rounded flat top downwardly convexed upper section arranged to position inside said covering at said closed bottom end when said pliable covering is rolled upwardly with said upper section holding said covering securely by closely fitting a concaved center in said second piece being a rounded bottom section of said two-piece base platform formed upwardly with said concaved center;

said upper section of said two-piece base platform having a cover protecting ring-like rolled edge there around;

means for applying weight to said flat top of said upper section of said two-piece platform providing pressurized retention of said closed bottom end of said covering secured between said two pieces of said two-piece base platform.

5. The device of claim 4 wherein said chemically resistant pliable covering is fabricated in a variety of suitable materials with a heavy gauge pliable plastic being the material of choice.

6. The device of claim 4 wherein said means for applying weight to said flat top of said upper section of said two-piece platform is a drum in the range of fifty-five gallon capacity or a similar container and any contents therein.

* * * * *